United States Patent [19]

Doery

[11] Patent Number: 4,508,447

[45] Date of Patent: Apr. 2, 1985

[54] ALTERNATIVE FEEDING DOCUMENT RECIRCULATION

[75] Inventor: Michael S. Doery, Rochester, N.Y.

[73] Assignee: Xerox Corporation, Stamford, Conn.

[21] Appl. No.: 487,404

[22] Filed: Apr. 21, 1983

[51] Int. Cl.[3] ..... G03G 15/00

[52] U.S. Cl. ..... 355/14 SH; 355/24; 355/50; 355/77; 271/3.1

[58] Field of Search ..... 355/14 SH, 3 SH, 23, 355/24, 26, 50, 77; 271/3.1, 9

[56] References Cited

U.S. PATENT DOCUMENTS

| | | | |
|---|---|---|---|
| 4,093,372 | 6/1978 | Guenther | 271/3.1 X |
| 4,099,150 | 7/1978 | Connin | 355/3 R |
| 4,140,387 | 2/1979 | Gustafson | 355/14 |
| 4,179,215 | 12/1979 | Hage | 355/50 |
| 4,184,671 | 1/1980 | Sasamori | 271/18 |
| 4,192,607 | 3/1980 | Hage | 355/50 |
| 4,196,898 | 4/1980 | Misawa et al. | 271/9 |
| 4,218,128 | 8/1980 | Satomi et al. | 355/14 SH |
| 4,231,561 | 11/1980 | Kaneko et al. | 271/3.1 |
| 4,278,344 | 7/1981 | Sahay | 355/14 SH |
| 4,313,673 | 2/1982 | Wartinger et al. | 355/14 R |
| 4,330,197 | 5/1982 | Smith et al. | 355/14 SH |
| 4,333,639 | 6/1982 | Davidge et al. | 271/3.1 |
| 4,391,504 | 7/1983 | Acquaviva | 271/3.1 X |
| 4,419,007 | 12/1983 | Kingsley | 271/3.1 X |
| 4,462,681 | 7/1984 | Aerts et al. | 271/3.1 X |

FOREIGN PATENT DOCUMENTS 52-14255 2/1977 Japan .

OTHER PUBLICATIONS

"Collated Duplex Copying Using a Simplex Feeder-Document Positioner", disclosed anonymously in the Research Disclosure as Publication No. 21608 of Apr. 1982, pp. 115-116.

IBM Technical Disclosure Bulletin, vol. 22, No. 7, Dec. 1979, pp. 2657-2659.

*Primary Examiner*—Richard L. Moses

[57] ABSTRACT

In an automatic document handling system for recirculating a set of document sheets seriatim in a page order to and from the imaging station of a copier for making precollated copy sheet sets, wherein the document handling system has a control system and two document trays, the improvement for higher speed document recirculation for copying on a copier having a high copying rate comprising: an automatic document sheet separating system controlled by said control means for automatically, during the first circulation of the set of document sheets, separating the set of document sheets into two half-sets of alternate page document sheets, odd and even, and restacking the half-sets respectively in the two document trays, and an automatic alternate document sheet cooperative feeding system actuated automatically by the control means on the second and subsequent copying circulations of the document set to feed document sheets alternately and overlapping in time from the two document sheet half-sets in the two document trays so as to feed document sheets at the high copying rate and in page seriatim order to be copied on said copier, and to automatically in the second and subsequent, but not the last, copying circulations, to reseparate the document sheets after they are copied in their return to the two document trays. A system specifically for handling duplex documents is also disclosed.

17 Claims, 2 Drawing Figures

ALTERNATIVE FEEDING DOCUMENT RECIRCULATION

Figure 1:
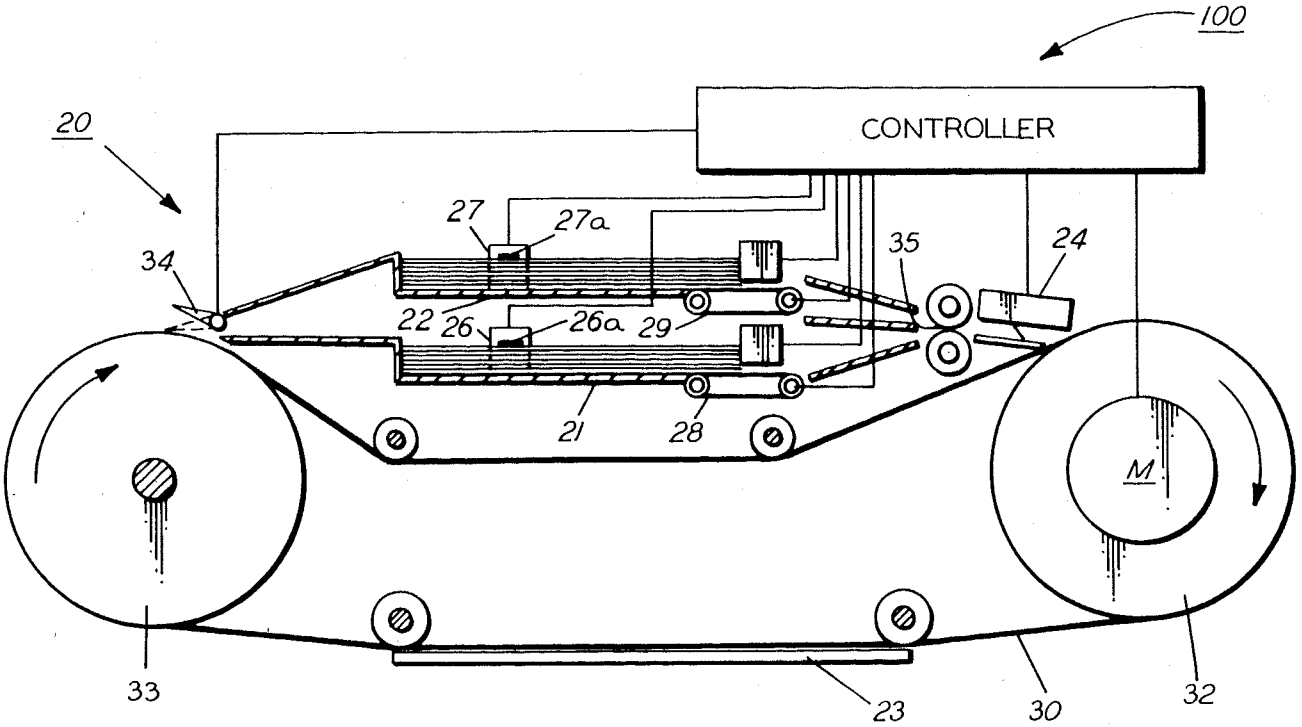

The present invention relates to a system for providing higher speed recirculatory precollation copying of sets of original document sheets.

The present invention is applicable to increasing the document copying rate and document handling reliability in precollation copying systems such as those described in U.S. Pat. Nos. 4,278,344 issued July 14, 1981 to Ravi B. Sahay and 4,330,197 issued May 18, 1982 to Richard E. Smith et al.. The recirculating document handling system disclosed herein may be used with copying apparatus disclosed in these and other references without substantial structural modification. However, the present system is not limited to that apparatus and is usable with various other present or future high speed copiers where it is desired to reliably feed documents sequentially and in proper order at the full copying rate of the copier.

As xerographic and other copiers increase in speed, and become more automatic, it is increasingly important to provide higher speed yet more reliable and more automatic handling of both the copy sheets and the original documents being copied, i.e. both the output and input of the copier. However, the providing of high speed recirculative document copying for high speed precollation copying, especially for duplex (two-sided) copying, greatly complicates and increases the document sheet and copy sheet handling complexities. In particular, with a high speed copier it is sometimes necessary to delay or skip a copying cycle of the copier to allow time for the proper original document to be acquired and fed to the copier imaging station, thereby reducing the true copying rate or productivity of the overall system, especially for precollation copying, where most frequent document exchanges are required.

The following terminology is generally used in the description herein: The term "sheet" generally refers to conventional sized flimsy sheets of paper, plastic, or other conventional or typical individual image substrates (original or copy), and not to microfilm or electronic images which are generally much easier to manipulate. However, the terms document, document page, or document image, unless specified as relating to sheets, may also be read as encompassing laser printed or otherwise electronically generated, stored, and/or rearranged images. The term "page" here generally refers to one side or "face" of a sheet or a corresponding image thereof. A "simplex" document or copy sheet is one having its page and image on only one side or face of the sheet, whereas a "duplex" document or copy sheet has pages on both sides. The term "duplex copying" may be more specifically defined into several different known copying modes. In "duplex/duplex" copying, both sides (both pages) of a duplex document sheet are copied onto both sides of a copy sheet. In "simplex/duplex" copying, the two page images of two successive simplex document sheets are copied onto the opposite sides of a single (duplex) copy sheet. In "duplex/simplex" copying, both sides of a duplex document are copied onto one side of two successive (simplex) copy sheets. In non-duplex copying, i.e. "simplex/simplex" copying, one side of each simplex document is copied onto one side of each copy sheet. In other printing arts, as contrasted to copier art, two-sided copying may be referred to as "backing-up" rather than duplex copying. A commercially desirable precollation document handling and copying system should compatibly provide all of these copying modes, although "duplex/simplex" need not be provided. The present system is particularly advantageous for a "simplex/simplex" or "simplex/duplex" precollation copying system but is fully compatible, with the same apparatus, with all of the other said copying modes.

"RDH" is an abbreviation for an automatic recirculating document handler, in which document sheets are automatically fed from a stack, copied and returned thereto, normally for a precollation copying system. The present system is particularly suited for a precollation (multiply recirculated) document copying system, but is also compatible with non-precollation copying with the same apparatus.

Precollation, or collation copying, as it is variably called, is a known desirable feature for a copier, which provides a number of important advantages. In precollation copying any desired number of precollated copy sets may be made by making a corresponding number of recirculations of the original document set in collated order past the copier imaging station and normally copying each document only once (or twice) each time it circulates past the imaging station. The copies automatically exit the copier in precollated sets, and thus do not require subsequent sorting in a sorter or collator. Proofing and on-line finishing and/or removal of any completed copy sets may thus be provided while further copy sets are being made from the subsequent circulations of the same document set.

However, a disadvantage of precollation copying systems is that the set of documents must be recirculated and copied in a predetermined seriatim page order by a number of set circulations equivalent to the desired number of copy sets. Further, for precollation simplex to duplex copying additional initial and/or final non-copying and/or only alternate document copying document set circulations may be required. These non-copying circulations are desirably at an even higher document feeding rate than the normal copying circulation rate. Thus, greatly increased and faster document handling is required for a practical precollation copying system as compared to a post-collation copying system. Also, for duplex copying the copy sheets must normally also be recirculated once in the copying path in coordination with the document set recirculation in order to print images on both sides thereof. Therefore, maximizing document handling automation and copying cycle efficiency is particularly important in precollation copying. If the document handler cannot efficiently and rapidly circulate and copy documents in coordination with copy sheets in the correct order, or must excessively skip documents or copying cycles, the total copying time for completing all of the copy sets will be increased. Also, for collation copying, minimizing the time delay from the initiation of copying until the first copy set is completed and outputted is another important factor. This may be referred to as "first copy set out time".

In contrast, in a post-collation copying system, several identical copies are made at one time from each document page. Collation must be done after copying by each identical copy being placed in a different sorter bin. The document set need only normally be circulated or manually or semi-automatically fed to the imaging station once. Thus, at the end of the document set circulation each utilized bin of the copy sheet sorter or collator contains one collated copy set. However, the number of copy sets which can be made in one document circulation is limited by the number of available sorter bins. Also, a sorter adds space and complexity and is not well suited for on-line finishing. Further, the "first copy set out time" for any completed sets is delayed for the copying collating of all the other sets of that copying run. However, post-collation copying, or manual document placement, are desirable in certain copying situations to minimize document handling. Also post-collation can employ slower document handling in that the copying rate is not limited by any document exchange times during the times the plural copies are being made. Thus, it is desirable in some cases that a precollation copying system be compatible with, and alternatively usable for, post-collation or manual document handling as well.

Both forward serial order (1 to N) and reverse order (N to 1) precollation copying of original documents, for both simplex (one sided) and duplex (two-sided) original documents and copies, is shown in the cited art. Examples of 1 to N, normal, or forward serial order, document recirculation systems for precollation simplex or duplex copying systems are disclosed in U.S. Pat. No. 4,229,101 to T. J. Hamlin et al., No. 4,234,180 to J. H. Looney, and No. 4,355,880 to D. J. Stemmle, and art cited therein.

However, as further explained below, N to 1 (reverse order) document set circulation is commercially more conventional for systems feeding documents from a tray positioned over a platen of a copier. In such conventional systems the set of documents is loaded (stacked) face-up, and each document sheet is fed out from the bottom of the stack, copied, and restacked back on the top of the stack. Thus the simplex documents are circulated in an endless loop by being turned over, copied, turned over again, and returned back to the top of the stack over the platen.

A major disadvantage of such N to 1 or backwards document feeding and copying order is that the copier controller does not know what document pages are being fed on the first circulation, since the last (Nth) page is fed first. Not knowing whether a document page being fed and copied is odd or even, and duplexing accordingly, has distinct disadvantages for making duplex (two sided) copies. If the number of original document pages is odd, the last (Nth) duplex copy sheet should be blank on one side, and also desirably will have special handling. Also the inversions of copy sheets will vary depending on whether there are an odd or even number of originals, affecting the copy sheet output orientation unless it is controlled in response to that information. This problem has lead to simplex/duplex copying with either precounting of the entire document set before copying (with an initial non-copying circulation) and/or selective use of a copy sheet inverter in the copy sheet path, with various disadvantages, as explained more fully below and in the above-cited patents.

Thus commercial RDH copying systems which feed documents in backwards or reverse page order, i.e. from the last or Nth page to the first page, provide, when simplex/duplex copying is selected, a non-copying initial counting circulation of all the simplex documents, to automatically determine whether the Nth (first copied) document is odd or even. This pre-count or slew cycle as it is called was first disclosed in the above-cited U.S. Pat. No. 4,330,197 by R. E. Smith and J. R. Yonovich.

This pre-count cycle, especially for a large document set, decreases the perceived productivity of the copier by cycling the document handler without imaging the originals at the beginning of copying when it is most noticeable. I.e., when there is no copy sheet output, finishing, or handling to occupy the operator's time. The larger the document set (the more document sheets) the greater this delay in first copy set out time for simplex/duplex copying using a pre-count circulation. A pre-count cycle, and also any increased use of a copy sheet inverter, also adversely affects system reliability by requiring extra handling of the document set and the copy sheets.

An important reason for using a precount cycle is that not knowing whether a document being fed is an odd or even page particularly complicates the simplex/duplex operation of a copier when it is desired to use letterhead, binder edged, pre-punched, marginal, or other special copy sheets which require a particular face or orientation of the copy sheet to be printed or bound. For example, with letterhead paper, for duplex copying page 1 must be printed on the letterhead side, not the obverse side. Using paper with ring or spiral binder holes, the odd document pages should be copied so that the holes are on the left hand side of the page and the even document pages should be copied so that the holes are on the right. Also, if the copier finisher has an on-line corner stapler, the copy sheets must be automatically placed in the finisher in the correct orientation for stapling the correct corners.

Note that these special paper problems cannot be overcome merely by providing different copy sheet output paths, as, for example in U.S. Pat. No. 4,362,379 issued Dec. 7, 1982 to F. J. A. M. Tiek et al (Oce-Netherland). However the latter patent is of particular interest for its discussion in Col. 1 of the "last-page problem" [even for conventional copy sheets] and for its avoidance of initially counting the number of originals, and for providing a different number of copy sheet output path inversions depending on whether an even or odd number of originals was detected in the first copying circulation. Also note that the copy of the first fed original is put in the duplex tray on the first circulation (Col. 5, lines 5–10), even if it is an odd page. This Nth-odd page must be fed on the second (and all subsequent) document copying circulations from the duplex tray to the output tray, i.e. undesirably fed back through the transfer/fixing station, where its blank backside may be contaminated, as described at Col. 5, lines 41–51, et al..

Further illustration of the odd last page problem is shown by the manual correction method with manual sheet insertion shown in the August 1976 "Research Disclosure" publication No. 14850, pp. 44–45.

However, N to 1 document recirculation has been commercially utilized in spite of these disadvantages because bottom feeding and top restacking is preferred for a "racetrack" document circulation path. The documents may be recirculated in a short over-platen loop to and from a document stack located over the copier platen, and the entire RDH may be in a pivotal platen cover unit. Documents can be fed from one edge of the stack to the same side or edge of the platen underneath the stack, and then back from the opposite edge of the platen to the opposite edge of the stack. The documents may be stream fed unidirectionally over the platen. One document may be fed on while the prior document is feeding off. The document path has a short 180° loop turn above each side of the platen. With a shorter and unidirectional document recirculation path, document transport speeds can be lower and/or the number of copy pitches skipped in copying small (2–6) sheet document sets can be reduced.

By way of further background as to known difficulties in integrating precollation document recirculation with duplex copying, in a properly collated set of duplex copy sheets the odd pages 1, 3, 5, etc., should normally appear on the first or front faces or sides. Only the next higher page number even pages 2, 4, 6, etc., should normally be on the respective second or back sides. The order of copying the document pages and the order of presenting the copy sheets to the images thereof must be coordinated to maintain proper page order for collation. Also, the number of duplex sheets will always be less than the number of pages on those duplex sheets. In contrast, in a set of simplex document or copy sheets, the number of the sheet will typically also correspond to the page number. Thus, an odd number of simplex sheets will normally also have a corresponding odd number of page images. However, a set of duplex sheets, regardless of the sheet count, may have either an odd or even number of pages. If there are an odd number of pages in the set of duplex sheets then the back side of the last sheet should normally be blank (clean). Other difficulties involved in efficient duplexing systems and sequences which are compatible with both simplex and duplex systems are discussed in the art cited herein and other duplexing art.

Of interest as relating to improved simplex/duplex precollation copying efficiency usable after the above-described precount circulation is U.S. Pat. No. 4,116,558, issued Sept. 26, 1978, to J. A. Adamek et al. That system is also described herein and in other above-cited patents. This Adamek patent teaches a more efficient RDH system for making duplex precollated copy sets usable with the present invention, and compatible with simplex copying, in which all of the simplex documents are copied on all but the first and last copying circulations. On the first and last copying circulations alternate simplex documents are copied (by circulating all documents but only exposing alternate ones) to form and remove an internal duplex copy buffer set of one-sided copies, as further explained hereinbelow.

Another form of collated duplex copying system usable with the present system is disclosed, for example, in U.S. Pat. No. 4,095,979 issued June 20, 1978 to A. B. DiFrancesco et al. In the latter type of duplexing system each copy sheet (and each duplex document) is turned over immediately for its second side image.

Some examples of further exemplary details of N to 1 or racetrack type recirculating document handlers are disclosed in U.S. Pat. Nos. 4,335,954 issuing June 22, 1982 to Russell L. Phelps; 4,270,746 issued June 2, 1981 to T. J. Hamlin; 4,324,395 issued Apr. 13, 1982 to Morton Silverberg and 4,076,408 issued Feb. 28, 1978 to M. G. Reid, et al.. Further suitable exemplary RDH details (on a set separator/stack height sensor) are in U.S. Ser. No. 373,919 filed May 3, 1982 and art cited therein. Further examples of a preferred system of document sheet acquisition and initial feeding from the bottom of an RDH document tray are shown in U.S. Ser. Nos. 317,211, 317,212 and 317,219, all filed Nov. 2, 1981 by, respectively, John M. Browne and Gerald M. Garavuso all by the same assignee.

A brief anonymous Disclosure Number 19015 at page 61 of the "Research Disclosure" published February, 1980 by Industrial Opportunities, Ltd., Homewell, Havant, Hampshire, U.K. is noted for suggesting that when duplex original documents are being recirculatively copied onto duplex copy sheets (in a copying system where the duplex documents must be immediately inverted each time for copying opposite sides in immediate sequence) that the consequent copying speed loss can be compensated for to some extent by making two consecutive copies of the same original each time. However, it requires 2 copy receiver trays.

Further details of one exemplary copier are disclosed in the following pending U.S. patent applications and foreign equivalents thereof: Ser. No. 372,581 filed Apr. 28, 1982 re optics; Ser. Nos. 420,965; 420,993 and 421,006 re controls, all filed Sept. 21, 1982; Ser. No. 420,966 filed Sept. 20, 1982 re copy sheet feeders; and Ser. No. 193,228 filed Oct. 2, 1980 and Ser. No. 443,799 filed Nov. 22, 1982 [and U.S. Pat. No. 3,856,295 issued Dec. 24, 1974 to J. H. Looney] re copy sheet inverters. Another inverter is shown in IBM Technical Disclosure Bulletin Vol. 18, No. 1, June 1975, p. 40.

Examples of various other patents teaching known document handlers and copiers and conrol systems therefor, including document and paper path switches and counters, are U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270 and 4,335,949. Conventional simple software instructions in a copier's conventional microprocessor logic circuitry and software of document handler and copier control functions and logic, as taught by the above and other patents and various commercial copiers, are well known and preferred. However, it will be appreciated that the document handling and other functions and controls described herein may be alternatively conventionally incorporated into a copier utilizing any other suitable or known simple software or hard wired logic systems, switch controllers, etc.. Such software for functions described herein may vary depending on the particular microprocessor or microcomputer system utilized, of course, but will be already available to or readily programmable by those skilled in the art without experimentation from the descriptions and references provided herein.

The control of the exemplary document and copy sheet handling systems disclosed herein may be accomplished by conventionally activating them by signals from the controller direct or indirectly in response to simple programmed commands and from selected activation or non-activation of conventional copier switch inputs by the copier operator, such as switches selecting the number of copies to be made in that run, selecting simplex or duplex copying, selecting whether the documents are simplex or duplex, selecting a copy sheet supply tray, etc. The resultant controller signals may conventionally actuate various conventional electrical solenoid or cam controlled sheet deflector fingers, motors or clutches in the copier in the selected steps or sequences as programmed. Conventional sheet path sensors, switches and bail bars, connected to the controller, may be utilized for counting and keeping track of the positions of documents and copy sheets, as is well known in the art, and taught in the above and other patents and products. Known precollation copying systems utilize such conventional microprocessor control circuitry and connecting switches for counting the number of document sheets as they are circulated, counting the number of completed document set circulations, and thereby controlling the operation of the document and copy sheet feeders and inverters, etc.

The following U.S. patents (listed in numerical order) were noted as of particular interest as disclosing document handlers for copiers with two trays for original document sheets: U.S. Pat. Nos. 4,099,150 issued July 4, 1978 to J. L. Connin; 4,140,387 issued Feb. 20, 1979 to G. B. Gustafson; 4,184,671 issued Jan. 22, 1980 to Y. Sasamori; 4,196,898 issued Apr. 8, 1980 to T. Misawa et al; 4,218,128 issued Aug. 19, 1980 to T. Satomi et al (FIG. 6); 4,231,561 issued Nov. 4, 1980 to T. Kaneko et al; and 4,333,639 issued June 8, 1982 to R. V. Davidge et al. As to said Connin U.S. Pat. No. 4,099,150 there is an equivalent publication but with additional FIGS. 10–13 and description with an operational error in Research Disclosure publication No. 14927 dated September 1976. Also noted in this regard is a Japanese Utility Model Application No. 52-14255, Laid Open No. 53-110128 laid open Sept. 2, 1978 by Ricoh Co., Ltd. Another type of two input system for original documents to a copier is shown for example, in U.S. Pat. No. 4,192,607 issued Mar. 11, 1980 to C. T. Hage. U.S. Pat. No. 4,179,215 issued Dec. 18, 1979 to C. T. Hage is noted for its recognition of throughput loss problems for small document sets and an RDH with only one tray but a bypass path with a return restacking stripping deflector gate.

An example of manual reversal of original documents for duplex copying is disclosed in U.S. Pat. No. 4,313,673 issued Feb. 2, 1982. It is known to interleave copies of one side of duplex documents with the originals to make up a pseudo simplex document set, as disclosed for example in "Research Disclosure" Publication No. 21608, dated April 1982, pp. 115–6; and other cited therein.

It is also known in a recirculating document handler to return simplex document sheets in a different return path from the platen from duplex document sheets, as shown for example in U.S. Pat. No. 4,229,101 issued Oct. 21, 1980 to T. J. Hamlin et al.; Japanese Application No. 53-94763 laid open Feb. 14, 1980 as Laid-Open No. 55-21073 and Xerox Disclosure Journal Vol. 6, No. 5, September/October 1981, pp. 265–6.

Of course, in paper feeding in general, including the feeding of copy sheets to a copier for copies to be made from original documents, it is known to use more than one tray for the copy sheets, and it is known to provide a cooperative or simultaneous feeding therefrom. Examples are shown in the following U.S. patents: U.S. Pat. No. Re. 26,896 reissued May 26, 1970 to R. J. Schmidlin et al; No. 983,219 issued Jan. 31, 1911 to M. A. Droitcour; No. 3,523,685 issued Aug. 11, 1970 to G. Ehlscheid; No. 4,017,181 issued Apr. 12, 1977 to S. Komaba et al; No. 4,033,576 issued July 5, 1977 to J. E. Stanfield; and No. 4,108,427 issued Aug. 22, 1978 to S. Komori et al. Providing two trays for copy sheets being duplexed is shown in IBM Technical Disclosure Bulletin Vol. 22, No. 7, December 1979, pp. 2657–2659.

All references cited herein, and their references, are incorporated by reference herein for appropriate teachings of additional or alternative details, features, and/or technical background.

The present invention desirably overcomes or reduces various of the above-discussed problems.

A preferred specific feature disclosed herein is to provide, in an automatic document handling system for recirculating a set of document sheets seriatim in a page order to and from the imaging station of a copier for making precollated copy sheet sets, said document handling system having control means and two document trays, the improvement for higher speed document recirculation for copying on a copier having a high copying rate at said high copying rate comprising: automatic document sheet separating means controlled by said control means for automatically, during the first circulation of the set of document sheets, separating the set of document sheets into two half-sets of alternate page document sheets and restacking said half-sets respectively in said two document trays; automatic alternate document sheet cooperative feeding means actuated automatically by said control means on the second and subsequent copying circulations of the document set to feed document sheets alternately from said two document sheet half-sets in said two document trays so as to feed document sheets at said high copying rate and in page seriatim order directly to be copied on said copier; and wherein said automatic document sheet separating means in said second and subsequent, but not the last, copying circulations is controlled by said control means to reseparate said document sheets after they are copied and return them to said two document trays.

Another specific feature disclosed herein is wherein said automatic alternate document sheet cooperative feeding means automatically acquires and begins feeding a sheet from one said tray simultaneously with the feeding of another sheet out of the other said tray to said copier after said first circulation.

Further features which may be provided by the method and apparatus disclosed herein, individually or in combinations, include those wherein said automatic sheet separation means separates said document sheets in their return from said imaging station to said two document trays; in which said control means includes means for determining which of said two document trays contains odd page documents or even page documents by the end of said first document set circulation, and automatically determining and controlling from which of said two trays said feeding is initiated to provide proper precollation copying; wherein if said documents are simplex documents and duplex copying thereof is selected said control means automatically causes said first circulation of said document set to be a non copying circulation and then initiates a special initial copying circulation of only the document sheets in only one of said two trays in a second circulation of said document set, and then automatically initiates alternately sequentially feeding from both of said two trays in subsequent circulations of said document set; and wherein said two document trays comprise an upper tray and a lower tray thereunder, and wherein said document set is initially loaded into said upper tray, and said automatic document sheet separating means is automatically controlled by said control means in the last copying circulation to feed all of said document sheets to only said upper tray after they are copied.

An additional feature disclosed herein is initially interleaving of one copy set of only one side of duplex documents if said document sheets are duplex documents in an initial copying circulation in which all said duplex documents are returned to one of said trays; then turning said document set over, and inserting in the other said tray said one copy set of one side of said duplex documents made on said initial copying circlation of said document set; and then automatically, on the second and subsequent copying circulations of the document set, feeding the document sheets alternately from said two document sheet half-sets in said two document trays, combined in page seriatim order, to be copied at said imaging station at said higher copying rate.

Figure 2:
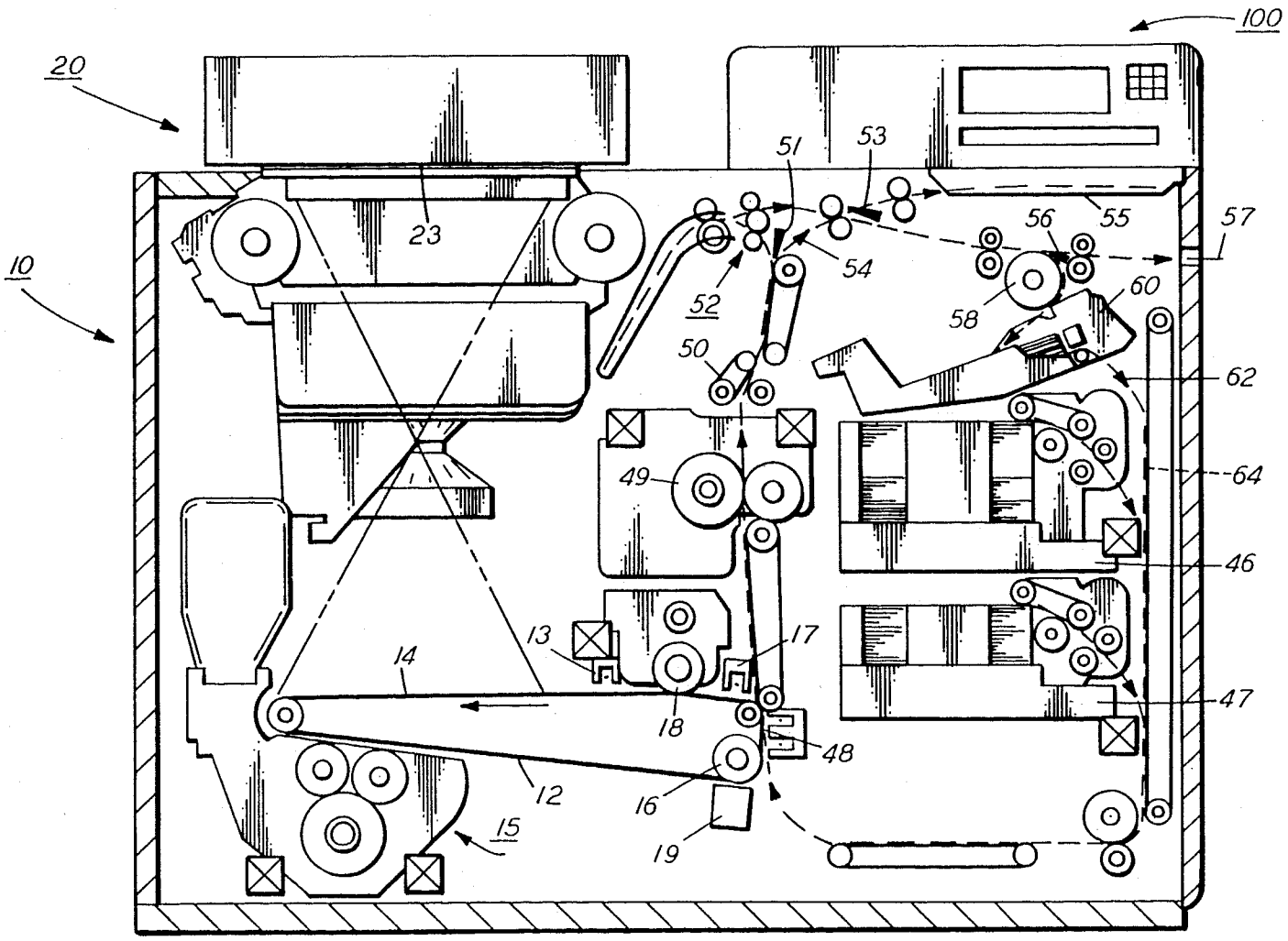

Various of the above-mentioned and further features and advantages will be apparent from the examples described hereinbelow of specific apparatus and steps of operation. The invention will be better understood by reference to the following description of one specific embodiment thereof, which includes the following drawing figures (approximately to scale) wherein:

FIG. 1 is a schematic cross-sectional side view of an exemplary recirculating document handler (RDH) for a copier with which the present invention may be practiced, and FIG. 2 is a side view, particularly illustrating copy sheet paths, of an exemplary copier on which the RDH of FIG. 1 is shown mounted.

Referring to the xerographic copier 10 shown in FIG. 2, but particularly to its automatic recirculating document feeding unit 20 shown in more detail in FIG. 1, it will be appreciated that they are merely one example, and that various other alternative recirculating document feeding units and copiers may be utilized with the present invention, including various ones disclosed in the above-cited references.

In the exemplary N to 1 order recirculating document handler (RDH) 20 disclosed here, individual original document sheets are normally initially sequentially fed from a stack of document sheets initially placed by the operator face-up in normal forward collated order in the upper tray 22 of two overlying document stacking and holding trays 21 and 22, i.e. loaded with page 1 on the top of the document stack. Document sheets are fed from the bottom of their stack seriatim to the imaging station 23, which is the conventional copying platen of the copier 10. There they may be conventionally imaged onto a photoreceptor 12 for the production of copies in a generally conventional xerographic manner, or, in some sequences, described herein for simplex/duplex copying, rapidly fed across the platen 23 without being copied, and in either case the documents are returned directly to a selected one of the two trays 21 or 22 overlying platen 23 as will be further described.

In the system herein, in most circulations alternate document sheets are restacked automatically at the conclusion of each circulation alternately in tray 21 and 22 over the platen 23. The document handler 20 has conventional switches or other sensors such as 24 for sensing and counting the individual documents fed from either of the trays 21 or 22, i.e. counting the number of document sheets circulated. In each tray 21 and 22 a conventional resettable bail or finger 26*a* and 27*a* drops to indicate through its associated set-counter switch or sensor 26 and 27 the completion of each circulation of all the documents in that tray by sensing that all the documents have been fed out from under the finger, which is then automatically reset on the top of the stack before the next circulation. The document feeder 20 is adapted to continually serially recirculate the documents until a selected number of copy sets is made therefrom. The document sheets may be various conventional sizes and weights of sheets of paper or plastic containing information indicia to be copied on one or both sides, e.g. printed or typed letters, drawings, prints, photographs, etc. Each tray 21, 22 has an independent but identical bottom sheet feeder 28 and 29 to respectively feed from the sheet stack therein the bottom-most document sheet, on demand, through the illustrated common feed path to a platen vacuum transport belt system 30 or other suitable transport, driven by motor M, which moves the document over the copier platen 23 into a registration position where the side of the document facing the platen 23 is copied. All said feeding activities are controlled, timed and sequenced by a controller 100.

Although not illustrated herein, there may be additionally provided in this document feeder 20 an inverter whereby each document may be selectably inverted or not inverted as it is fed from the tray 22 to the imaging station 23 or in the return to trays 21 or 22 through one of two paths selectable by the controller, a simplex document path and a duplex document path. The two paths may be provided by a selectably reversible sheet drive roller (inverting roller) and a selectable position gate or deflector in the document path, as shown for example in the above-cited U.S. Pat. No. 4,278,344.

Each document sheet in the illustrated system of FIG. 2 is fed initially from one of trays 21 or 22 around the outside of a roller 32 and supporting belt 30. Thus all documents are inverted as they are fed onto the platen 23. They are inverted against around a second belt 30 roller 33 in the return path to the trays 21, 22. At that point all the returning documents must pass a decision gate 34. When gate 34 is solenoid actuating up, the next returning document is deflected and fed into tray 21 to restack on top of any sheets therein. If gate 34 is down (its illustrated dashed-line position) subsequent returning sheets restack in tray 22 instead. Controller 100 counts the belt 30 movement distance and time from switch 24 for both lead edge arrival and trail edge passage of the document sheets at gate 34. An additional sensor can be provided there also. The decision gate 34 in the document path here is adjacent the top of roller 33 and comprises pivotable deflector fingers which may be raised or lowered after the trail edge of the preceding document has passed this gate.

In the total circulation path from the bottom of either tray 21 or 22 back to the top thereof, the documents are inverted twice around both rollers 32 and 33. Thus they restack in the same orientation (face-up), but not necessarily in the same tray. That is, with two total path inversions per circulation there is effectively no inversion per circulation. Thus, the documents will be restacked in the tray 21 or 22 in their original orientation, and the same sides of the documents will be exposed in the next circulation.

In the method of precollation copying of a set of plural (multipage) simplex document sheets to be further disclosed herein, the document sheets are presented to the imaging station 23 of the copier 10 in N to 1 or conventional reverse serial page order. They are multiply recirculated between the stacked set of the document sheets and the imaging station 23, and copied once (or twice) on one side per circulation at the imaging station, by feeding the document sheets seriatim from the bottom of a stack to one side of said imaging station and then returning the document sheets from the opposite side of said imaging station to the top of a stack, in a recirculatory loop path. However, unlike the prior systems, after the first circulation the documents here are normally fed alternately, but overlapping in initial acquisition time, from the two trays 21, 22.

Further, here the document sheets are divided into half-sets in the first circulation which are maintained in the separate trays 21, 22 until the last circulation.

As noted, in the systems disclosed in the above-cited U.S. Pat. Nos. to Adamak 4,116,558, Sahay 4,278,344, and Smith et al. 4,330,197, for making duplex copies from simplex document sheets in a desired manner, in the first copying circulation and the last copying circulation of the set of document sheets only every alternate document sheet is copied at the imaging station to fill and deplete a duplex tray buffer set, respectively, but in all other circulations all documents are copied, with alternate feeding from a main copy tray and the duplex copy tray. However, as taught in the latter patent that system may also require a non-copying initial document circulation to determine whether documents being fed are odd or even for N to 1 (reverse order) document recirculation. In either case the first circulation is used herein to divide, via alternate activation of sheet gate 34, the odd and even page document sheets into two half sets, each stacked in its own tray 21 or 22. This separation is then maintained by corresponding gate 34 actuations for all the subsequent copying circulations.

In the system here, no significant hardware changes are required over prior systems other than the addition of another document tray and its feeder. Otherwise fully compatible precollation copying may be provided with the same basic document handler and copier merely by providing an additional or modified program in the copier controller 100 programmer. Operator document loading steps as described herein may be conventional.

The exemplary copier 10 processor, disclosed in the above U.S. Pat. No. 4,278,344, and the controller 100 will now be briefly described here. The copier 10 conventionally includes a xerographic photoreceptor belt 12 and the xerographic stations acting thereon for respectively corona charging 13, image exposing 14, image developing 15, belt driving 16, precleaning discharge 17 and toner cleaning 18. A densitometer 19 control may also be provided. The X in a square symbols illustrate slide-out mountings of modular components. The copier 10 is adapted to provide duplex or simplex precollated copy sets from either duplex or simplex original documents copied from the same RDH 20. Two separate copy sheet trays 46 and 47 are provided for feeding clean copy sheets selectably from either one. They are normally known as the main tray 46 and auxiliary tray 47. The control of all sheet feeding is, conventionally, by the machine controller 100.

The controller 100 is preferably a known programmable microprocessor, exemplified by the art cited above, which conventionally also controls all of the other machine steps and functions described herein including the operation of the document feeder, the document and copy sheet gates, the feeder drives, etc. As further disclosed in those references, the controller 100 also conventionally provides for storage and comparison of the counts of the copy sheets, the number of documents recirculated in a document set, the desired number of copy sets and other selections by the operator through the panel of switches thereon, time delays, jam correction control, etc.

The copy sheets are fed from the selected one of the trays 46 or 47 to the transfer station 48 for the conventional transfer of the xerographic toner image of a document page to the first side of a copy sheet. The copy sheets here are then fed by a vacuum transport to a roll fuser 49 for the fusing of the toner image thereon. From the fuser, the copy sheets are fed through a sheet decurler 50 to a gate or deflector finger unit 51 which functions as an inverter selector. Depending on the position of the gate 51 the copy sheets will either be deflected into a copy sheet inverter 52 or bypass the inverter 52 and be fed directly onto a second pivotal decision gate 53. Those copy sheets which bypass the inverter 52 turn a 90° corner path 54 in the sheet path which inverts the copy sheets into a last-printed face-up orientation before reaching a second gate 53. That is, the image side which has just been transferred and fused is face-up at this point. If the inverter 52 sheet path is selected instead (by gate 51) the opposite is true (the last-printed sheet face is face-down at this point).

This second decision gate 53 then either deflects the sheets directly into an output tray 55 or deflects the sheets into a transport path which carries them on without further inversion to a third decision gate 56. If this third gate 56 is down it passes the sheets directly on without inversion into the output path 57 of the copier. If gate 56 is up it deflects the sheets into a duplex inverting transport 58. The inverting transport (roller) 58 inverts and then stacks copy sheets to be duplexed in a duplex tray 60 when the gate 58 so directs.

The duplex tray 60 provides intermediate or buffer storage for those copy sheets which have been printed on one side and on which it is desired to subsequently print an image on the opposite side thereof, i.e., copy sheets in the process of being duplexed. Due to the sheet inverting by the roller 58, these buffer set copy sheets are stacked into the duplex tray 60 face-down. They are stacked in this duplex tray 60 on top of one another in the order in which they were copied.

For the completion of duplex copying, the previously simplexed copy sheets in the tray 60 are fed seriatim by its bottom feeder 62 back to the transfer station 48 for the imaging of their second or opposite side page image. This is through basically the same copy sheet transport path (paper path) 64 as is provided for the clean (blank) sheet from the trays 46 or 47. It may be seen that this copy sheet feed path 64 between the duplex tray 108 and the transfer station 48 has an inherent inversion which inverts the copy sheets once. However, due to the inverting transport 58 having previously stacked these buffer sheets printed face down in the duplex tray 60, they are represented to the photoreceptor 12 at the transfer station 48 in the proper orientation, i.e. with their blank or opposite sides facing the photoreceptor 12 to receive the second side image. This is referred to as the "second pass" for the buffer set copies being duplexed. The now fully duplexed copy sheets are then fed out again through the fuser 49 to be stacked in tray 55 or fed out into the output path 57.

The output path 57 transports finished copy sheets (either simplex or duplex) to another output stacking tray or, preferably, to an on-line finishing station. There the completed precollated copy sets may be finished by stapling, stitching, glueing, binding, and/or off-set stacking in a module therefor (not shown here).

If alternative non-precollated output is provided, as by using the RDH 20 in a known semi-automatic stream feeding mode utilizing only platen transport 30, or alternative manual document placement, then the output path 57 may alternatively connect to a sorter module. The sorter can have an inherent sheet path inversion if 1 to N order document presentation order is used.

It is desirable to minimize the operation of the copy sheet output inverter 52, in order to simplify and shorten the paper path and increase its reliability. Its use also depends on the inherent inversions provided within the paper path of the copier. The exemplary inverter 52 here operates by the gate 51 deflecting a copy sheet face-down into the first or lower nip of the illustrated three roll inverter, which drives the sheet into the inverter chute. The copy sheet's forward movement may then be stopped and reversed within the inverter chute by known or suitable sheet reversing means, e.g., further rollers as shown. The reversed copy sheet is then driven out of the inverter 52 through the second or upper nip of the same three roll inverter unit directly toward the gate 53. The curved shape of the inverter chute acting on the beam strength of the sheet causes the sheet trail edge to flip up toward this second nip. Note that the inverter 52 here is positioned at a corner of an otherwise inherent 90° paper path inversion as described above. However, any other suitable sheet inverter may be utilized, and may be provided at different positions in the copy sheet output path.

By way of further background as to the difficulties in copy sheet output orientation and order for precollation, for which the inverter 52 may be utilized, there are several known problems and solutions in maintaining the proper collation of the copy sheets in the output tray or finisher, particularly with reproducing machines which must do both simplexing and duplexing, as discussed in the cited U.S. Pat. No. 4,278,344 and elsewhere. Collated duplex copying output presents particular output collation difficulties and requirements, depending on which side is printed last, etc.. As noted above, on each duplex copy sheet a lower and odd, document page number must be on one side of the copy sheet and the next higher, and even, document page number must be on the opposite side of that copy sheet. Thus, when N to 1 copying the last-printed page in each set is always page two printed on the back of the page one sheet, or vice versa, and this last duplex copy sheet is exited with page 2 down. In each completed set of copies the outputted duplex copies as picked up by the operator should be in the proper precollated page order 1/2; 3/4; 5/6; etc., even though they were copied in the reverse page number order, and even though odd page sides may be printed before even page sides, or vice versa, depending on the system selected.

Providing properly collated output without normally using an inverter is made more difficult for duplex copies by the fact that the total overall copy sheet path for the copies being duplexed is typically different, i.e., contains more inversions, than the overall copy path for copy sheets which are only being simplexed, since it is necessary to turn the duplex copy sheets over to present their opposite sides for their second copying pass. In the particular duplex sheet path herein each sheet to be duplexed is inverted once at the duplex tray 60 input 58, a second time in the return path to the transfer station 48, and a third time in the path from the transfer station 48 to the output 57, to exit last-printed-face-up, unless the inverter 52 is used. If the second sides printed are the odd sides, a N to 1 output may be stacked with these last-printed odd sides facing up without using inverter 52. If, alternatively, the last-printed sides are even pages, duplex copy output may be inverted at 52 or elsewhere in the output to maintain collation. However, it is desirable to have commonality, i.e., to utilize the same sheet feeding path to the maximum extent possible for both duplex and simplex copies, and to normally avoid using a selectable output inverter such as 52 for either. Thus, the inverter 52 path is desirably normally bypassed by path 54 here by gate 51. This same path 54 avoiding the inverter 52 is also desirably used for simplex copies.

However, further, by way of background, there is an additional problem in the situations where there are an odd rather than even number of simplex document pages to be copied onto a duplex copy set. With an odd number of document pages the Nth or first-copied page of the set of duplex copies made therefrom in N to 1 order is really a simplex copy. That is, in the completed copy sets the bottom copy sheet will have an image on only one side (of the odd Nth page) and a blank opposite side. I.e. a last odd copy sheet is properly a simplex copy sheet even though part of a duplex copy set. It is undesirable to run this Nth odd page only copy sheet through the transfer station a second time for the pseudo printing of a blank image on the back side thereof simply to obtain an additional inversion of that sheet to maintain output collation, since this wastes processing time and also can cause undesirable background contamination of the blank back side of this sheet. [However, it can be handled this way if desired.] This can be avoided by printing the Nth odd page on a clean sheet from tray 46 or 47 and directly outputting it immediately after its first side is printed rather than feeding it from or into the duplex tray 60. This normally results in this copy sheet having a different number of inversions, as discussed, but this particular sheet can then be inverted by the inverter 52 to provide proper collation with the rest of the copy set sheets.

However, to treat an odd Nth copy page differently in this manner it is essential to know whether there are an odd or even number of simplex documents. This normally has required a document pre-count cycle, particularly to allow the use of orientation sensitive copy sheets.

That is, where simplex documents are copied in reverse serial order (N to 1) the first document fed is page N and the first (Nth) duplex copy sheet will be the one requiring special duplex processing, i.e., needing a blank back side when N is odd. Since this Nth copy sheet is fed first it is not known whether the Nth document page is odd until after the entire set of documents has all been counted.

Orientation sensitive copy sheets, e.g. pre-printed, letterhead, binder hole or the like copy sheets present a special problem. They normally cannot have a first even page printed on a pre-printed front side. Nor can they be imaged upside down to any pre-printing. E.g. page 1 must be on a letterhead side and oriented with the pre-printing orientation. Nor can the last Nth odd page be inverted relative to the pre-printing or printed only on its backside. Nor can binder holes be on the right side of a page. This is an additional complication for duplex copying and for the above-described Nth odd page handling problem. It is also important to be able to use common stack orientation for alternative simplex copying on the same special (orientation sensitive) copy sheets without having to reload the special copy sheets into trays 46 and 47 with a different orientation.

As disclosed, for example in the above-cited Sahay U.S. Pat. No. 4,278,344, etc., a preferred simplex/duplex precollation system (for making duplex copies from simplex document sheets) is as follows: For N–1 (reverse page order) copying there is a first non-copying precount circulation by RDH 20 to count the number of simplex document sheets. Then in the second circulation (first copying circulation) of the document set only alternate document sheets (e.g., only the even pages) are copied at the imaging station 23 to make and fill duplex tray 60 with a buffer set of half-completed duplex copies. Then in all subsequent copying circulations (except the last) all of the document sheets are copied, but onto sheets fed alternately from copy tray 46 (or 47) and duplex tray 60. Those documents copied onto sheets from tray 46 or 47 are being temporarily placed in tray 60 for the next circulation (except for an Nth odd page) at the same as those documents copied onto the sheets fed out from tray 60 are being outputted as completed duplex copies. In the final document circulation only the other alternate document pages not copied in the first copying circulation are copied. They are copied onto sheets fed only from the duplex tray 60, to deplete the buffer set from duplex tray 60.

A preferred compatible duplex/duplex precollation system (for copying duplex documents onto duplex copy sheets) is also taught in said Sahay U.S. Pat. No. 4,278,344. No precount circulation is required, but the number of document sheets in the document set is counted in the first (copying) circulation. Only one side (e.g. only even page sides) of the duplex document sheets are copied in the initial circulations. The copies of this one side are stored as an intermediate buffer set in duplex tray 60. After a calculated integral number of said initial document set circulations corresponding to a desired maximum number of copies to be accumulated in said buffer set (e.g., 14 divided by the number of document sheets counted plus 1) the duplex documents are inverted during the next copying circulation, and then the other sides of the duplex documents are copied in an equal number of subsequent circulations onto the copy sheets from duplex buffer tray 60 and outputted as completed duplex copy sets. When the tray 60 is depleted the documents are inverted again and the above-described cycles are repeated until the desired number of copy sets are completed.

A compatible duplex/simplex copying system is taught in the above-cited Hamlin et al. U.S. Pat. No. 4,229,101. The duplex documents are always copied onto only one side of only clean copy sheets from trays 46 or 47. The simplex copies of one side of the duplex documents are placed in duplex tray 60, and then may be fed out through the normal duplex copying path 62, but without being imaged on their other sides, and being fed alternately (interleaved) with simplex copies made of the other sides of the documents from trays 46 or 47.

In the system here, no copier 10 hardware changes are required. Improved speed but fully compatible precollation copying may be provided with these same basic above-described copying systems at the same imaging station merely by applying a partially different selectable software program to the controller 100 to provide a different process of separating, feeding, and copying or not copying selected document pages from the different RDH 20 here.

Considering now particularly the operation of the document handling unit 20 of FIG. 1 for producing precollated copy sheet sets, two basic modes of operation will be described. First, the copying of simplex documents, both for simplex and duplex copying thereof. Then a method of copying duplex documents with this disclosed document handling unit 20 which does not require a document inverter, yet will provide the same high production (copying) rates. In both copying modes, the original documents are loaded face up in the uppermost, most easily operator accessable, top tray 22, with the same convenience as a conventional single tray RDH. However, by pivotably mounting the upper tray 22 to the frame of the RDH, access to the lower tray 21 thereunder is easily provided where needed for jam clearance, or for copying duplex documents as described later hereinbelow. For the copying of simplex original documents, access to the lower tray 21 would be required only in the rare event of a non-automatically recoverable document feeding jam. In all normal modes of operation, including recoverable jam conditions, the controller 100 is programmed to restack all of the original documents in the upper tray 22 at the end of the last circulation of the documents for operator removal.

Referring now to the two said simplex/duplex copying system, as described above, the first circulation of the document set will normally be a high speed precount cycle in which the documents are not copied but rather are rapidly fed past the switch or sensor 24 to be counted and fed over the platen 23 without being stopped or imaged, in order to determine whether the number of simplex original documents is odd or even, thereby providing information for the controller 100 for properly controlling copying as described above.

In all copying modes with the RDH 20, the controller 100 controls the actuating and operating times of the document feeders 28 and 29 so as to feed documents sequentially, but so that one document is being acquired and initially fed at the same time as another document is being fed out onto the transport belt system 30. That is, the air knife and vacuum being applied to the vacuum corrugating feeders are achieving the pull down and initial separation of one bottom sheet from one stack while the preceeding sheet is being pulled away by the nip of the take-away rollers nip 35 into which said initial feeders 28 and 29 both feed document sheets through the illustrated converging baffles or sheet guides extending therebetween. This provides a greatly increased time period for such acquisition and initial feeding, for greatly increased sheet feeding reliability, as compared to attempting to feed sheets from a single feeder from a single tray at the full copying rate of a copier 10. Furthermore, only half as many documents must be fed by each feeder 28 or 29 in each copying circulation of the document set as compared to normal single tray RDH operation. This great increase in available time for initial sheet acquisition and initial feeding is very important, because this is the most time critical part of the entire recirculation of the document sheets. Furthermore, in a normal RDH system, this acquisition time is the limiting factor in the interdocument pitch, i.e. the time and distance between the trail edge of one document and the lead edge of the next document. In contrast, with this system, this interdocument pitch can be effectively eliminated, i.e. made as small as practical consistent with the imaging area on the platen 23. That is, for normal (approximately 1:1 magnification) or for document image reduction onto a smaller copy sheet, where the imaging area is approximately the same size as the document sheet size, documents can be fed in the recirculating loop in continuous immediately-adjacent sequential flow, with as little as one centimeter distance therebetween. This may be assisted by precise or even preliminary actuation of the return gate 34, e.g. by lifting the gate 34 before the trail end of a document being fed into tray 22 has passed this gate 34. Likewise the gate 34 may be dropped before the trail edge of a sheet being fed into tray 21 has passed the tip of the gate so as to catch the lead edge of the subsequent document for deflection and restacking into tray 22.

It is important to note that with the present two-tray system, contrary to some of the above cited prior art, there is no increase in the number of circulations required for the document set. Nor are any noncopying circulations required for the purpose of feeding document sheets from one tray 22 to the other tray 21, or vice versa, for reordering or inverting the document sheets or the like.

The only non-copying circulation of the document set with this system will occur only when it is desired to provide an initial counting circulation, or precount cycle, as described above and in the cited art for simplex/duplex copying. However, even in this initial circulation, the documents are not merely circulated to and from the same tray. Rather, the returning documents are divided equally into two half-sets of document sheets, by actuating gate 34 adjacent the trail end of each document to put alternate simplex document sheets in alternate paths to alternate trays 21 or 22. Thus at the end of the first circulation of the document set, all of the even page documents will be in one tray and all of the odd page documents will be in the other. That is, one of the two half-sets comprises all even page documents and the other comprises all odd page documents. It will not be known by the controller 100 until all of the documents have been fed by the feeder 29 from tray 22 in this first circulation, so that the finger 27*a* has dropped to indicate through set counter switch 27 that a complete set has been circulated, whether or not there was an odd or even number of documents placed in the tray 22. However, at the end of this first circulation, the controller will know .from the count from switch 24 whether there were and odd or even number of documents initially in tray 22, and will know whether the gate 34 was preset up or down for the first (Nth) document sheet fed, and will therefore know which tray contains the odd pages and which tray contains the even pages. That is, if there were an odd number of documents and the gate 34 was initially up as shown, at the end of the first copying circulation all of the odd documents will be in tray 21. Thus, if it is desired to copy even page sides first in the first copying circulation in the above-described simplex/duplex copying mode, then the first document sheet to be fed for copying will be an even page document fed from tray 22 by feeder 29.

For the preferred simplex/duplex copying mode described above, the controller 100 initiates a special initial copying circulation on the first copying circulation of only the document sheets in one of the two trays e.g. only the document sheets fed from the tray 22 if even pages are desired to be copied first to make up an even page buffer set in the duplex tray 60. Note that although this is the first copying circulation it is the second circulation of the document set. In the subsequent copying circulations of the document set, controller 100 then automatically initiates alternate sequential feeding of documents from both trays 21 and 22, as previously described. The abovedescribed overlapping feeders 28 and 29 may be used to feed document sheets at the rate of up to greater than 200 documents per minute, for example, yet utilizing conventional state-of-the art high reliability document feeders 28 and 29 as described for example in the above-cited U.S. Pat. No. 4,324,395 to Mort Silverberg and the other references cited therewith in the introductory section of this description. Even at such high document feeding speeds, a normal document acquistion time can still be allowed for feeders 28 and 29, for example 300 milliseconds, without introducing any interdocument time loss with this system.

Note that the only significant disadvantage of the present system over a single tray RDH, other than the slight additional height required to accommodate restacking of one half of the document set in the tray 21, is the additional cost of this extra tray 21 and feeder 28 and set counter 26. However this cost can be significantly reduced by utilizing a common intergral vacuum/air pressure supply, requiring only a separate valve, and by using a common drive motor, requiring only a separate clutch, for the separate actuating times of the feeders 28 and 29.

Note that the cooperative overlapping operation of the two feeders 28 and 29 may extend even to feeding of one sheet into its chute or guide toward the common nip 35 simultaneously or overlapping in time with the feeding of the trail end portion of the preceeding sheet through its separate guide, pulled by the nip 35.

Turning now to the use of the RDH 20 for copying duplex (two-sided) original documents, there is disclosed a system which does not require a mechanical sheet inverter for the duplex documents. Nor is complex manual interleaving of a set of copies of one side of the documents with the original documents required either. The latter is known, but confusing to the operator, i.e. forming a "pseudo simplex" set of documents so that only one side thereof need be copied in a simplex recirculating document handler. In contrast, with the RDH 20, a much simpler duplex document copying method may be employed. The duplex documents, which are initially placed in the tray 22, are circulated and copied on one side thereof in the first circulation. In that first circulation all of said duplex documents are preferably returned only to the lower document tray 21, by holding gate 34 up during the entire circulation. During this first circulation a set of simplex copies is made by the copier 10 and outputted to the output tray 55. These simplex copies of one side of the duplex original documents are then simply placed by the operator in the upper document tray 22. Then, automatically on the second and all subsequent copying circulations of the document set, sheets are fed alternately from the two document trays 21 and 22, the same as for simplex documents as described above. That is, the copying sequence is identical except that the controller 100 is automatically programmed in response to operator switch selection of duplex document copying on the control panel of the copier 10 to make this initial set of copies of one side of the duplex documents and then cause the copier and RDH to pause for the placement of this initial single copy set in tray 22, to be used as original documents thereafter. Furthermore, also in response to said duplex copying selection, the controller 100 also automatically executes a special and different operation of the RDH 20 on the last circulation of the documents. The original duplex documents, which were initially placed in tray 21, are returned to the upper tray 22, for access and removal by the operator in this last circulation. Note however, that this can be done instead on the second copying circulation rather than the last copying circulation if desired. Further, on the last copying circulation, the set of copies of one side which were placed in tray 22 at the beginning of the second circulations are preferably automatically ejected from the RDH 20 rather than returned to either of the trays 21 or 22. Alternatively however, they may be returned to the tray 21, and the diagnostic display on the console of the copier can provide a message instructing the operator to remove them. Note that for duplex document copying there are no non-copying circulations, and that for all but the first circulation, the above-described advantages of very high speed immediately sequential document feeding with relatively slow document acquisition times are provided for copying duplex documents in this manner as well.

While the precollation copying system embodiment disclosed herein is preferred, it will be appreciated that this embodiment is but one example, and that various alternatives, modifications, variations or improvements thereon may be made by those skilled in the art from this teaching which are intended to be encompassed by the following claims.

What is claimed is:

1. In an automatic document handling system for recirculating a set of document sheets seriatim in a page order to and from the imaging station of a copier for making precollated copy sheet sets, said document handling system having control means and two document trays, the improvement for higher speed document recirculation for copying on a copier having a high copying rate at said high copying rate comprising:

automatic document sheet separating means controlled by said control means for automatically, during the first circulation of the set of document sheets, separating the set of document sheets into two half-sets of alternate page document sheets and restacking said half-sets respectively in said two document trays;

automatic alternate document sheet cooperative feeding means actuated automatically by said control means on the second and subsequent copying circulations of the document set to feed document sheets alternately from said two document sheet half-sets in said two document trays so as to feed document sheets at said high copying rate and in page seriatim order directly to be copied on said copier;

and wherein said automatic document sheet separating means in said second and subsequent, but not the last, copying circulations is controlled by said control means to reseparate said document sheets after they are copied and return them to said two document trays.

2. The automatic document handling system of claim 1 wherein said automatic alternate document sheet cooperative feeding means automatically acquires and begins feeding a sheet from one said tray simultaneously with the feeding of another sheet out of the other said tray to said copier after said first circulation.

3. The automatic document handling system of claim 1 wherein said automatic sheet separation means separates said document sheets in their return from said imaging station to said two document trays.

4. The automatic document handling system of claim 1 in which said control means includes means for determining which of said two document trays contains odd page documents or even page documents by the end of said first document set circulation, and automatically determining and controlling from which of said two trays said feeding is initiated to provide proper precollation copying.

5. The automatic document handling system of claim 3 wherein if said documents are simplex documents and duplex copying thereof is selected said control means automatically causes said first circulation of said document set to be a non copying circulation and then initiates a special initial copying circulation of only the document sheets in only one of said two trays in a second circulation of said document set, and then automatically initiates alternately sequentially feeding from both of said two trays in subsequent circulations of said document set.

6. The automatic document handling system of claim 1 wherein said two document trays comprise an upper tray and a lower tray thereunder, and wherein said document set is initially loaded into said upper tray, and said automatic document sheet separating means is automatically controlled by said control means in the last copying circulation to feed all of said document sheets to only said upper tray after they are copied.

7. The automatic document handling system of claim 5 wherein said automatic alternate document sheet cooperative feeding means automatically acquires and begins feeding a sheet from one said tray simultaneously with the feeding of another sheet out of the other said tray to said copier.

8. In an automatic document handling method for recirculating a set of documents sheets seriatim in a page order for copying on a copier imaging system for making precollated copy sheet sets, the improvement for higher speed document circulation for copying at a higher copying rate comprising the steps of:

automatically, in a first circulation of the set of documents, separating the set of document sheets into two half-sets of alternate page document sheets and sequentially placing said half-sets respectively in two different document trays;

automatically, on the second and subsequent copying circulations of the document set, feeding the document sheets alternately from said two document sheet half-sets in said two document trays, combined in page seriatim order, to be copied at said imaging station at said higher copying rate;

and wherein during said second and subsequent, but not the last, copying circulations said document sheets are re-separated into said half-sets after they are copied as they are returned to said two document trays.

9. The automatic document handling method of claim 8 wherein a sheet is automatically acquired and begins feeding from one said tray simultaneously with the feeding of another sheet out of the other said tray to said imaging station.

10. The automatic document handling method of claim 8 wherein said separation is such that one said half-set in said one tray comprises even-page simplex document sheets and the other said half-set in the other said tray comprises odd-page simplex document sheets.

11. The automatic document handling method of claim 8 including the steps of determining which of said two document trays contains odd page documents or even page documents by the end of said first document set circulation, and automatically from said determining controlling from which of said two trays said feeding is initiated to provide proper precollation copying.

12. The automatic document handling method of claim 8 wherein if said documents are simplex documents and duplex copying thereof is selected said first circulation of said document set is automatically a noncopying document sheet counting circulation followed by a special initial copying circulation of only the document sheets in only one of said two trays before said second and subsequent copying circulations.

13. The automatic document handling method of claim 8 wherein said two document trays comprise an upper tray and a lower tray thereunder, and wherein said document set is initially loaded into said upper tray, and wherein in the last copying circulation all of said document sheets are fed to only said upper tray.

14. The automatic document handling method of claim 12 wherein a sheet is automatically acquired and begins feeding from one said tray simultaneously with the feeding of another sheet out of the other said tray to said copier.

15. The automatic document handling method of claim 13 wherein a document sheet is automatically acquired and begins feeding from one said tray simultaneously with the feeding of another sheet out of the other said tray to said copier in said second and subsequent copying circulations.

16. The automatic document handling method of claim 13 comprising the further steps of:

initially making one copy set of only one side of said documents if said document sheets are duplex documents in an initial copying circulation in which all said duplex documents are returned to one of said trays, then turning said duplex document set over, and inserting in the other said tray said one copy set of one side of said duplex documents made on said initial copying circulation of said duplex document set, and then automatically, on the second and subsequent copying circulations of the document set, feeding sheets alternately from said two document trays, in page seriatim order, to be copied at said imaging station at said higher copying rate.

17. In an automatic document handling method with a document handling system having two document sheet trays for recirculating a set of duplex document sheets seriatim in a page order for copying on a copier imaging system for making precollated copy sheet sets, the improvement for higher speed document circulation for copying at a higher copying rate comprising the steps of:

loading said duplex documents in one of said trays;

initially making one copy set of only one side of said duplex documents in an initial copying circulation in which all said duplex documents are fed directly from said one tray to be copied and returned to one of said trays, then turning said duplex document set over, and inserting in the other said tray said one copy set of one side of said duplex documents made on said initial copying circulation of said duplex document set, and then automatically, on the second and subsequent copying circulations of the document set, feeding sheets alternately but overlapping in feeding time from said two document trays, combined in page seriatim order, to be copied at said imaging station at said higher copying rate.

* * * * *